United States Patent [19]

Dittmann

[11] 4,063,794

[45] Dec. 20, 1977

[54] BATTERY POST CONNECTOR

[75] Inventor: Larry Eugene Dittmann, Harrisburg, Pa.

[73] Assignee: AMP Incorporated, Harrisburg, Pa.

[21] Appl. No.: 687,065

[22] Filed: May 17, 1976

[51] Int. Cl.[2] ..... H01R 11/26

[52] U.S. Cl. ..... 339/230 R; 339/95 B; 339/256 RT

[58] Field of Search ..... 339/95 B, 229, 230 R, 339/251, 256 RT, 258 R, 258 A

[56] References Cited

U.S. PATENT DOCUMENTS 2,089,718 8/1937 Teitelbaum ..... 339/95 B 2,222,577 11/1940 Thompson ..... 339/230 R

*Primary Examiner*—Roy Lake
*Assistant Examiner*—E. F. Desmond
*Attorney, Agent, or Firm*—Allan B. Osborne

[57] ABSTRACT

An electrical connector for storage battery posts stamped and formed from a coplanar sheet of conducting material. A plurality of tabs are bent from either side of the strip of material to form a plurality of C-shaped spring members. The opposing spring members have dissimilar radii so that after the strip is formed into a circular shape, the inner surface is tapered to fit the trapezoidal configuration of the posts.

15 Claims, 7 Drawing Figures

BATTERY POST CONNECTOR

BACKGROUND OF THE INVENTION

1. Field of the Invention

This invention relates to a unique and improved connector for storage battery posts and the like.

2. Description of the Prior Art

Traditionally storage batteries of the type used in cars, trucks and the like have posts which are of lead and have a trapezoidal shape; i.e., more precisely, a frustum of a right circular cone. Each non-parallel side tapers outwardly as it approaches the battery surface at a 3½° angle.

Also traditionally, the connector most often used with battery posts has been and currently still is a split ring device which is made of lead with a resilient spring member embedded therein. A nut and bolt passing through outwardly projecting yoke-like arms draw the split ring tight about the post. U.S. Pat. No. 2,039,669 illustrates such a connector. The cable attaching portion disclosed in that patent is also predominatley used today, particularly in the replacement market.

Improvements to the connector have been advanced over the years but with limited commercial success. Generally the improvements are directed toward the two problems of corrosion; i.e., removing a corroded connector from the post without damaging the post or battery, and secondly offsetting the lack of resiliency of the lead connectors. As would be expected, many of the improvements were on the split-ring connector or its predecessor, a solid ring connector such as disclosed in U.S. Pat. No. 1,565,786. However, there have been a number of patents issuing over the years which were structurally different; i.e., a departure for the well known commonly used connector. For example, U.S. Pat. No. 1,924,334 disclosing a connector comprising a tapered sleeve having slots on its top and bottom edges to permit expansion or contraction according to the diameter of the post. The upper half of the sleeve was exteriorly threaded to receive a threaded cap. A ring was driven down the outside of the tapered sleeve by the cap to contract the sleeve about the post. A cavity in the cap held grease to combat the corrosion effect of the acid spray from the battery.

An Italian Pat. No. 459,729 issued Oct. 4, 1950, disclosing a nearly identical device.

U.S. Pat. No. 3,663,927 teaches a device similar to the above. A frusto-conically shaped portion positioned on a terminal lug is slotted and exteriorly threaded. A cap of insulating material and interiorly threaded forces the frusto-conical portion inwardly to provide a tight fit on the battery post.

Lever-operated connectors have been advanced for many years to overcome the corrosion problem. U.S. Pat. No. 1,491,056, teaches a connector having two opposing clamp members pivotally connected together. A lever or cam, positioned between the two free ends or arms of the members forces the clamp or jaw ends against or away from the post.

U.S. Pat. No. 2,737,636 discloses a conventional split-ring connector wherein a rotatable cam has been substituted for the nut and bolt. By rotating the cam through about ninety degrees the connector is drawn tight against the post. Reversing the direction of rotation relases the connector.

A connector employing the same concept is disclosed in U.S. Pat. No. 3,005,181. The connector body is elongated with the battery post-receiving opening being rectangular at one end and rounded at the other. A angled block is slidably positioned at the rectangular end. A rotatable cam, located intermediate the connector body ends, drives a shaft which is fastened to the block. By rotating the cam downwardly to a position parallel to the connector body, the block forcefully clamps the post between it and the rounded end which is also angled. The block is withdrawn by rotating the cam upwardly.

U.S. Pat. No. 3,944,318 represents another approach to solving the corrosion and non-resiliency problems. The connector disclosed therein consists of two parts or halves which are joined at one end by an interfingering-like arrangement and at the opposite end by a nut and bolt. Semi-circles in each half between the ends provide a post-receiving opening. The connector very easily comes apart and does not have to be pried or pulled off a corroded battery post.

Not all battery post connectors are made from lead; connectors stamped and formed from sheet metal made their appearance early. One such device is taught in U.S. Pat. No. 1,676,387. From a T-shaped blank the arms are formed around to encircle the battery post with a bolt securing the ends. The tongue portion is formed around into a closed barrel ferrule to receive the battery cable.

U.S. Pat. No. 2,089,718 which issued on Aug. 10, 1937 disclosed a stamped connector whose post encircling strap is U-shaped with the laterally directed flanges being serrated to provide post contacting and gripping teeth.

In U.S. Pat. No. 2,222,577 a stamped and formed connector is disclosed in which the post encircling portion is also channeled; i.e., the edges are bent at right angles to the body of the blank.

Still another approach to battery post connectors is disclosed in U.S. Pat. No. 3,568,138. The connector therein is made by stamping and bending a sheet of metal to form two aligned holes which fit onto the battery post. A lug is provided on each side so that a bolt may pass from there through the base of the connector whereby the sidewalls defining the holes may be tightened to seat the connector on the post.

SUMMARY OF THE INVENTION

This invention relates to an electrical connector formed from a single piece of conductive material and comprises a hoop portion for engaging a battery post and integral ferrule portion for attachment to an electrical conductor. More particularly the hoop portion consists of a plurality of tabs bent in from opposing sides of a medium strip. The radius of tabs on one side differs from that of the tabs on the opposite side so that upon forming the strip into a circular form, the opening has a taper adapted to fit the trapezoidal configuration of the post.

The object of the present invention is to provide a unique and improved connector which is quickly and easily affixed to battery posts with a resilient grip which exerts a high compressive force against the battery post and thereby provides excellent electrical interfaces and resists loosening by jarring and vibrations.

Still another object of the present invention is to provide a connector incorporating heat exchanger means thereon to prevent current loss through a temperature rise.

Yet another object of the present invention is to provide a connector which is economically stamped and formed from a coplanar sheet of conductive material.

Another object of the present invention is to diclose a method of providing a connector with a post-receiving opening whose walls described a non-cylindrical shape without use of mandrels or the like.

Other objects and attainments of the present invention will become apparent to those skilled in the art upon a reading of the following detailed description when taken in conjunction with the drawings in which there is shown and described an illustrative embodiment of the invention; it is to be understood however, that this embodiment is not intended to be exhaustive nor limiting of the invention but is given for purposes of illustration in order that others skilled in the art may fully understand the invention and the principles thereof and the manner of applying it in practical use so that they may modify it in various forms, each as may be best suited to the conditions of a particular use.

In order that the invention may be properly understood one example of connector in accordance therewith and a stampled blank from which the connector is folded will now be described by way of example only with reference to the accompanying drawings.

DESCRIPTION OF THE PREFERRED EMBODIMENT

Figure 1:
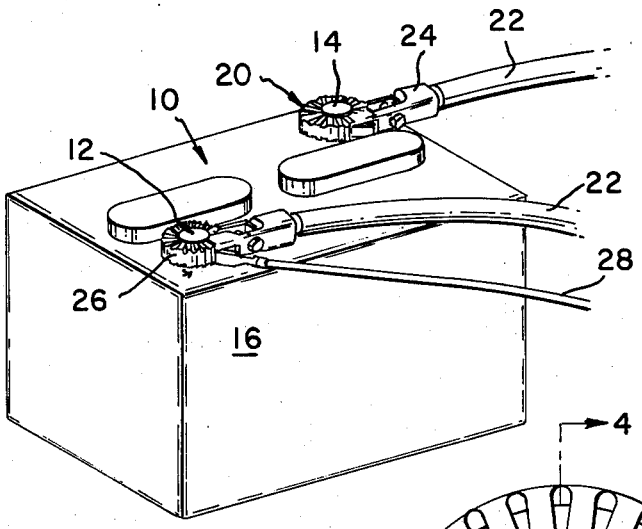
FIG. 1 illustrates in perspective a typical use of the present invention on a battery.

Reference numeral 10 in FIG. 1 points out a typical storage battery used in cars, trucks, boats and the like. It has two posts 12 and 14, the former being the cathode or positive post and the latter being the anode or negative post. Both posts are frustums of a right circular cone whose non-parallel sides taper outwardly towards the battery case 16. The taper is generally a 7° angle. The positive post 12 is slightly larger in diameter than the negative post 14. Both posts are generally made from lead.

Battery 10, shown in FIG. 1, uses a fluid electrolyte and has top-mounted posts. The connector of the present invention however can be and is intended to be used with all types of storage batteries having lead posts. Further, as will be evident upon a reading of the description of the preferred embodiment, the invention concepts therein can be utilized for posts, studs and the like of different configurations and different uses.

The pair of connectors 20 shown in FIG. 1 on the battery are constucted in accordance with the preferred embodiment of the present invention. Cables 22 carrying current to and from the battery are secured to the integral ferrule portions 24 of the connectors while the hoop portions 26 are in encompassing engagement with posts 12 and 14. A secondary power wire 28 is removably attached to a tab-terminal 30 (FIG. 3) on connector 20. Wire 28 supplies power to accessories such as radios and lights.

Figure 2:
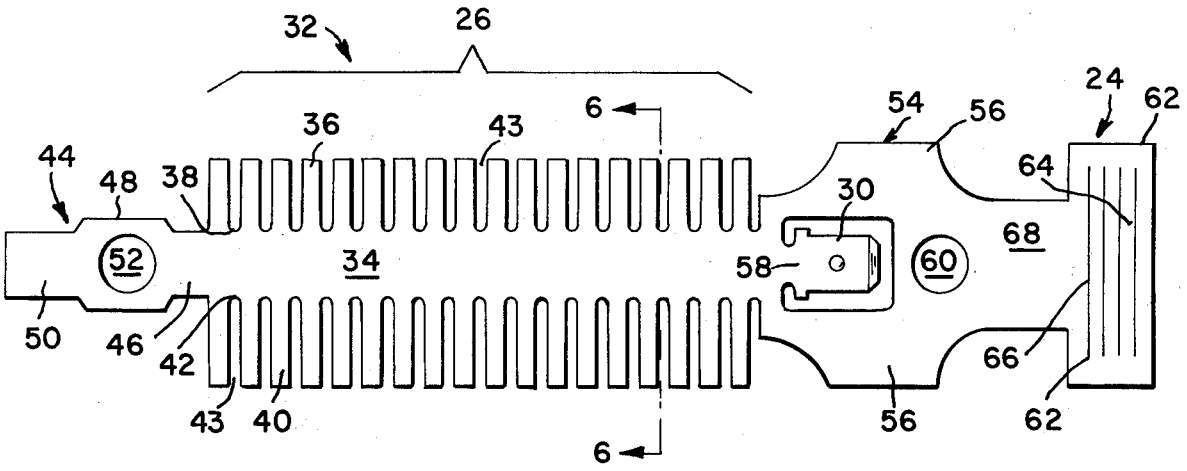
FIG. 2 is a plan view of a stamped blank prior to being formed into the connector of FIG. 3.

With specific reference to FIG. 2, blank 32 is stamped from a flat piece of stock material (not shown), preferably of brass having a thickness of from 0.50 to 0.60 inches. The hoop portion 26 is that elongated section bracketed by the brace and includes the medium strip 34, a plurality of tabs 36 projecting outwardly from side 38 and a pulrality of tabs 40 projecting outwardly from opposite side 42. Tabs 36 and 40 are of equal width as are slots 43 therein between. Tabs 36 however are shorter than tabs 40 by a factor of about 13%.

In front of hoop portion 26 is lug portion 44. It consists of a connecting strap 46 which is a continuation of medium strip 34, a bolt support section 48 and a forwardly projecting stub 50. The bolt support section contains a bolt-receiving aperture 52.

Immediately to the right of the hoop portion is a channel member or side support portion 54. A pair of wings 56 extend laterally from either side. The aforementioned tab terminal 30 is stamped out from the interior of the support portion as shown. This terminal is of conventional shape and receives thereon a receptacle such as those made and sold by AMP Incorporated of Harrisburg, PA. under the trademark "FASTON". The tab terminal 30 is connected to the support portion by strap 58.

A second bolt-receiving aperture 60 is located to the right of the tab terminal.

The aforementioned ferrule portion 24 is at the far right end or rear of the blank. It has two ears 62 extending laterally, from either side of what will become the ferrule floor 64. The surface of the ferrule portion contains several grooves 66. These grooves, as is well known in the art, provide an improved crimped termination. Other types of termination aids can also be used; e.g., the asymmetrical pattern of cavities disclosed in U.S. Pat. No. 3,892,459. The ferrule portion is integrally attached to the side support portion 54 by a strap 68.

Figure 7:
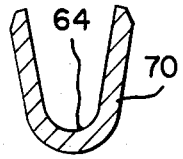
FIG. 7 is a view taken along lines 7—7 in FIG. 5.
Figure 5:
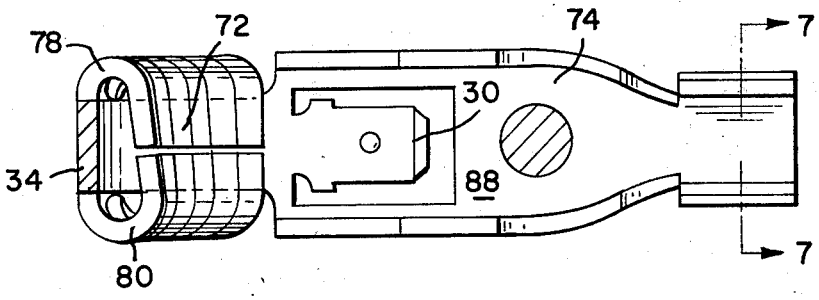
FIG. 5 is a view taken along lines 5—5 in FIG. 3.

In forming blank 32 into a connector 20 the ears 62 on the ferrule portion are folded up to define floor 64 and vertical sidewalls 70 (FIG. 7). The wings 56 and the edges on strap 68 are also hewed up to form a channel 74 (FIG. 5).

Figure 3:
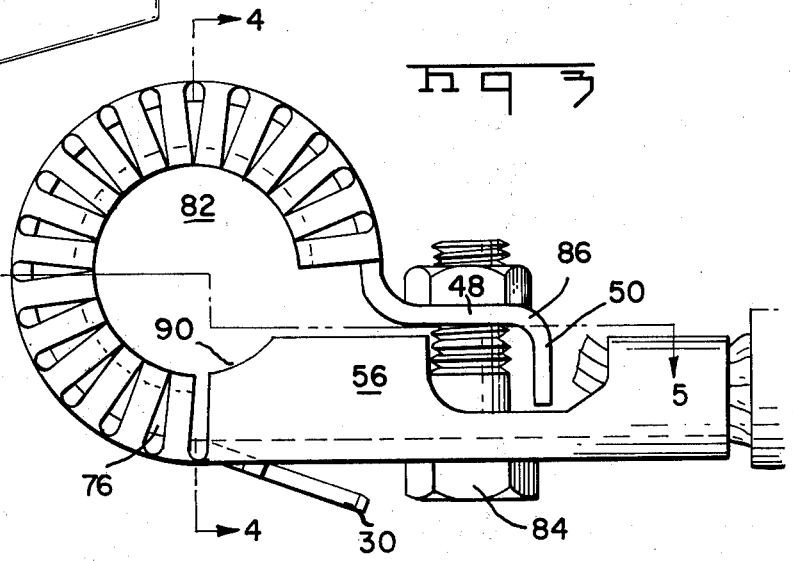
FIG. 3 is a top plan view of the connector of the present invention constructed in accordance with the preferred embodiment.
Figure 4:
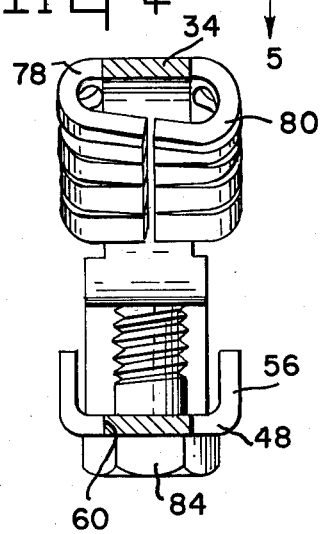
FIG. 4 is a view taken along lines 4—4 in FIG. 3.

Stub 50 is bent around to lie at a right angle to the bolt support section 48. The whole of lug portion 44 is bent is the opposite direction to lie at a right angle to the medium strip (FIG. 3). The latter bend is across strap 46 while the former is at the juncture of the stub and bolt support section 48.

Figure 6:
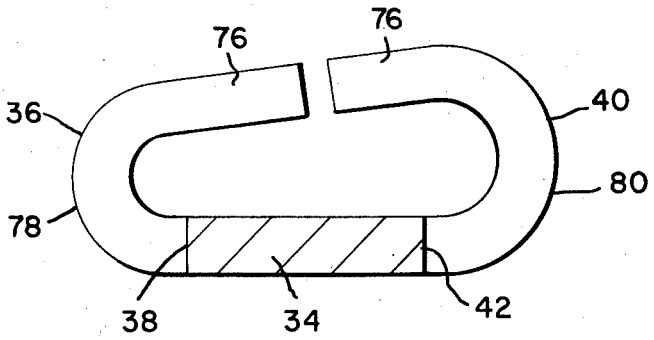
FIG. 6 is a view taken along lines 6—6 in FIG. 2.

In forming hoop portion 26 into the circular shape shown in FIG. 3 tabs 36 and 40 are first curved around over the medium strip 34 so that the free ends 76 of opposing tabs face each other across a short space. The curved structure resulting is generally oval as shown in FIG. 6. The curving of tabs 36 is done on a radius resulting in convex surface 78 beginning from near side 38 on the medium strip. Tabs 40 are formed on a larger radius to provide a larger convex surface 80 beginning adjacent to side 42 of the strip. The curving effects only the inner sections of the tabs so that the outside sections or free ends 76 remain straight.

The effect of forming the two sets of tabs on different radii is that the free ends describe an angled surface with respect to the medium strip. In this embodiment, the angle is of 3½°.

The circular shape of hoop portion 26 is now formed by curving it around so that the lug portion 44 overlies channel 74 of the side support portion.

In bringing the hoop portion around into the circular configuration, a mandrel or other forming devices are not required. The lug portion is simply grasped and pulled around through a generally curved path to where it is in alignment with the channel member portion. As the hoop portion is being brought around, the tabs themselves prescribe the exact required diameter of the post-receiving opening 82 and further automatically form the tapered structure of the opening. The medium strip becomes an outer wall and the tabs provide an inner wall. The term "wall" is used herein in the sense of a non-solid partition such as a picket fence. The tabs having spaces therein between provide something less than a solid wall. The self-sizing of the opening happens because as an edge of one tab abuts the adjacent tab's edge; i.e., the slot 43 between the two adjacent free ends 76 becomes closed, no further movement radially inwardly can occur by those individual tabs. It can be seen that any desired diameter opening can be obtained simply by proper slot and tab widths. As to the shape of the opening, it is preordained by the angle (relative to the medium strip) of each opposing pair of tabs resulting from their being curved about a selected radii. As the surface of such pairs in the present embodiment are at $3\frac{1}{2}°$ angle, the opening's walls then provide a taper of 7°.

Cable 22 is attached to the formed connector 20 by laying a bared end into the ferrule floor 64 and crimping the sidewalls 70 about it. This crimping technique is well known in the art and does not constitute part of the present invention.

The formed hoop portion 26 is tightened about a post by means of bolt 84 passing through apertures 52 and 60, and nut 86. As the nut and bolt are tightened, stub 50 approaches and contacts the floor 88 of channel 74. Further tightening causes the stub to bend back in on itself; i.e., towards the bolt. This deformation acts as a lock washer against the nut and restrains it from vibrating loose.

Referring specifically to FIG. 3, hoop portion 26 occupies about 270°. The arcuate-shaped sections 90 on ears 56 occupy about 50°. Thus a post will be almost completely encompassed by the connector.

The tabs 36 and 40 after forming become spring members having resiliency which, when the hoop portion is tightened, exert a high compressive force radially inwardly against the post. The flat side of the tabs press into the softer lead post creating a locking condition against unintentional rotational and vertical movement.

Electrical contact is further enhanced by leaving the burrs from the stamping on the tab ends. These burrs (not shown) scrape the lead to expose fresh metal. They also help in preventing rotational movement of the connector.

Slots 43 which are closed adjacent free ends 76 remain open about the upper and lower curved surfaces of the hoop portion. These slots permit a flow of air through the connector and the tab act as finned heat exchangers. An indication of the efficiency of this heat exchanging means is that connectors of the present invention experienced a stable temperature during a 3000 cycle test consisting of 20 second flow of current at 350 amps alternating with 220 seconds of no current flow.

After the aforementioned 3000 cycle test, the five connectors being tested experienced absolutely no contact resistance change; i.e., the connectors were virtually unaffected by the large amounts of current flowing through the interface (the region where the connector makes contact with the post).

Additional tests also show that with very little applied torque to the fastening members (nut and bolt), an excellent electrical interface was established. The amount of torque was between 10 and 15 inch-pounds. Also excellent mechanical gripping was obtained when the fastening members were tightened with fingers only.

As was noted above, the two battery posts, 12 and 14, differ in diameter. For this reason conventional battery post connectors of the split-ring type are provided in two sizes, one for the positive post and one for the negative post. The difference in post diameters with respect to the present invention does not require having two differently sized connectors 20. The diameter of the post-receiving opening 82 fits the negative or smaller post 14. To fit the connector onto the larger post, one needs only to pull the lug portion back away from side support portion 54. This opens up post-receiving opening 82.

In summary the present invention provides a novel connector composed of a plurality of tabs bent around to comprise spring members forming a circular opening. These members, being resilient, exert compressive forces on a post positioned in the opening. That these forces are effective was borne out by the above noted current cycling test. Further, the compressive forces aid in releasing the connector from contact with the post.

The present invention discloses a method of providing a post-receiving opening whose walls are of a non-cylindrical shape, the desired configuration thereof being a function of bending the opposing tabs about differing radii. Further, a cylindrically shaped opening can be provided by bending the opposing tabs on identical radii. Additionally the compound shape is obtained without the use of mandrels and the like. Further, the diameter of the opening is a direct result of the width of the slots and tabs.

Still another novel feature of the connector constructed in accordance with the present invention is that the slots and tabs effect a heat exchanging means to prevent excessive temperature increases.

The flat side of the tabs offer an anti-rotation locking means by being impressed on the post.

The foregoing detailed description has been given for clearness of understanding only, and no unnecessary limitations should be understood therefrom, as some modifications will be obvious to those skilled in the art.

What is claimed is:

1. An electrical connector for use on a battery post or the like, comprising a channel member, a hoop portion extending from one end of said channel member, and an electrical cable-receiving portion extending from the other end of the channel member, said hoop portion comprising an outer wall with a plurality of tabs spaced along said wall and extending from either side thereof, said tabs being inwardly bent upon themselves to form a substantial closed cross-section in the hoop portion and to provide an inner wall defining a post-receiving opening.

2. The electrical connector of claim 1 wherein the tabs are inwardly bent on a radius.

3. The electrical connector of claim 2 wherein the tabs on one side of the outer wall are inwardly bent on a radius different from that for the tabs on the opposite side.

4. The electrical connector of claim 3 wherein the tabs defining the post-receiving opening describe a taper.

5. The electrical connector of claim 1 further having a lug portion attached to the free end of the hoop portion and extending therefrom so as to be in general alignment with the channel member.

6. The electrical connector of claim 5 further including fastening means adapted to draw the lug portion and channel member together so as to reduce the diameter of the post-receiving opening.

7. An electrical connector stamped and formed from a coplanar strip of metal for use on a battery post or the like, comprising:

a. a ferrule portion at one end having floor and sidewalls, said ferrule adapted to be crimped into encompassing engagement onto an electrical cable;

b. a channel member positioned longitudinally near the ferrule portion having sidewalls and a floor with an aperture through the floor;

c. a hoop portion with one end attached to the channel member and formed into a circular shape so that the other end approaches the channel member, said hoop portion including an outer wall with a plurality of tabs on each side thereof being curved around inwardly to provide a wall spaced inwardly from the outer wall, said tabs being independently resilient and collectively defining a post-receiving opening;

d. a lug portion attached to the other end of the hoop portion and having an apertured section in general alignment with the aperture in the channel member; and e. clamping means extending through the apertures in the lug portion and in the channel member floor for drawing the lug portion toward the channel member, and thereby reducing the diameter of the post-receiving opening.

8. A method of forming an electrical connector for use on battery posts and the like, the method comprising the steps of:

a. providing a strip of metal;

b. stamping and forming a channel member intermediate the ends of the strip;

c. stamping and forming a cable receiving ferrule near one end of the channel member;

d. stamping a hoop portion from the strip adjacent the other end of the channel member, said hoop portion having a medium strip with a plurality of tabs extending laterally from either side;

e. rounding said tabs inwardly on a radius so that the free ends thereof are straight and overlie the portion of the strip; and f. curving the hoop portion round back on itself whereby the free ends of said tabs define a post-receiving opening.

9. The method of claim 8 wherein the radius of rounding the tabs on one side of the medium strip differs from the radius of rounding the tabs on the other side so that each pair of opposing free ends describe an angle with respect to the medium strip.

10. The method of claim 9 wherein the step of curving the hoop portion round back on itself provides a tapered, post-receiving opening.

11. The method of claim 8 further including the step of forming clamping means for reducing the diameter of the post-receiving opening.

12. The step of claim 11 wherein the forming of said clamping means include stamping a aperture in the channel member and forming an aperture-containing lug portion on the free end of the hoop portion whereby upon curving the hoop portion round, the apertures are aligned to receive tightening means therethrough adapted to draw the lug portion toward the channel member and thereby reduce the diameter of the post-receiving opening.

13. An electrical connector for use on a battery post or the like, comprising a cable-receiving means, a hoop portion extending from one end of the cable-receiving means, said hoop portion comprising an outer wall with a plurality of tabs spaced along said wall and extending from either side thereof, said tabs being inwardly bent upon themselves to form a substantial closed cross-section in the hoop portion and to provide an inner wall defining a post-receiving opening.

14. The electrical connector of claim 13 wherein the tabs are inwardly bent on a radius.

15.The electrical connector of claim 14 wherein the tabs on one side of the outer wall are inwardly bent on a radius different from that for the tabs on the opposite side.

* * * * *